United States Patent [19]

Nurse

[11] 4,357,171

[45] Nov. 2, 1982

[54] MILL FOR CANE SUGAR AND RELATED USES

[76] Inventor: William A. Nurse, 6, Wyncroft Close, St. Georges Rd., Bickley, Kent BR 2 LG, England

[21] Appl. No.: 232,998

[22] Filed: Feb. 9, 1981

[30] Foreign Application Priority Data

Feb. 27, 1980 [GB] United Kingdom ..... 8006553

[51] Int. Cl.[3] ..... B30B 3/04

[52] U.S. Cl. ..... 127/5; 127/3; 100/70 A; 100/168; 100/170

[58] Field of Search ..... 127/2, 3, 4, 5, 6; 100/70A, 170, 171, 168, 162 R, 169

[56] References Cited

U.S. PATENT DOCUMENTS

| | | | |
|---|---|---|---|
| 1,184,294 | 5/1916 | Aitken | 100/168 X |
| 1,259,393 | 3/1918 | Graham | 100/170 X |
| 1,289,675 | 12/1918 | Cos | 100/170 X |
| 1,539,502 | 5/1925 | Okrassa | 100/169 X |
| 2,190,029 | 2/1940 | Kopke | 100/170 X |
| 3,049,074 | 8/1962 | Mellin | 100/168 X |
| 3,611,917 | 10/1971 | Bryce et al. | 100/170 X |
| 4,023,480 | 5/1977 | Biondetti | 100/170 X |
| 4,077,316 | 3/1978 | Georget | 100/169 X |
| 4,080,890 | 3/1978 | Dreher | 100/170 |
| 4,156,453 | 5/1979 | Schelnecker | 100/168 X |
| 4,212,504 | 7/1980 | Krylov et al. | 100/170 X |

FOREIGN PATENT DOCUMENTS

| | | | |
|---|---|---|---|
| 2251622 | 6/1975 | France | 127/3 |

*Primary Examiner*—Kenneth M. Schor

*Attorney, Agent, or Firm*—W. G. Fasse; D. F. Gould; D. H. Kane, Jr.

[57] ABSTRACT

A mill, particularly a mill for extracting juice from cane sugar, has a fixed top roller (24), and feed discharge rollers (25) and (26) which are independently pivotable by respective power operated means (47, 51) to vary the feed opening between the feed roller and top roller and the discharge opening between discharge roller and top roller. A trash plate (55) for transferring material between the feed opening and the discharge opening is connected to the feed roller for pivotable movement therewith.

20 Claims, 6 Drawing Figures

MILL FOR CANE SUGAR AND RELATED USES

CROSS-REFERENCE TO RELATED APPLICATION

The present application corresponds to British Patent Application No. 80 06 553, filed in Great Britain on Feb. 27, 1980. The priority of said British filing data is hereby claimed.

BACKGROUND OF THE INVENTION

This invention relates to a mill and particularly but not exclusively to a cane sugar mill for extracting juice from cane sugar.

Known cane mills comprise a mill housing including a pair of spaced upright frames in which three rollers are journalled for rotation about parallel horizontal axes which form or substantially form an isosceles triangle having a horizontal or substantially horizontal base. In such known mills the lower rollers, that is to say the two rollers traditionally called the feed and discharge rollers, are fixed, whereas the top roller is hydraulically movable toward and away from the base of the isosceles triangle to enable adjustment of the respective openings between the feed roller and top roller (hereinafter called "the feed opening") and between the discharge roller and top roller (hereinafter called "the discharge opening") during mill operation. The feed and dischage rollers are capable of adjustment when the mill is inoperative. Bagasse is transferred between the feed and discharge rollers by what is termed, inter alia, a trash plate disposed between the feed and discharge rollers and maintained in constant mesh with the feed roller.

In such a mill it is essential to provide a larger feed opening than discharge opening and specifically ratios varying between 3.5:1 and 1.7:1 have been used in practice, although a ratio of about 2:1 has been found preferable.

However, although initially the preferred ratio may be set this ratio will alter in the aforesaid mill disadvantageously during movement of the top roller toward or away from the base of the isosceles triangle.

Moreover, during operation of a mill having a preferred ratio of about 2:1, the reaction which the bagasse applies to the top roller is greater on the discharge side than on the feed side and it is believed that the resultant force thus applied to the top roller is inclined to the vertical on the feed side thereof by an angle of about 15°. If the top roller bearings are housed for strictly vertical movement then such movement is hindered by the resultant force which tends to cause wedging of the top roller bearings in their respective housings during such vertical movement. In an attempt to minimize this disadvantage it is known that the position on the hydraulic ram is offset vertically and toward the feed side of the vertical center line of the top roller. Alternatively it is known that some mills are provided with top roller bearing housings inclined with respect to the vertical head of frames by some 15° toward the feed side so that the top roller bearings move more or less in the same direction as the aforesaid resultant force. This does not, however, obviate the disadvantage, since the direction of the resultant force will vary as the ratio of feed opening to discharge opening varies from the preferred value. Furthermore, the ratio of feed opening to discharge opening will depart during movement of the top roller to a greater degree from the preferred constant value in such a mill.

A mill is also known in which the feed and discharge rollers are journalled in a lower housing while the top roller is journalled in an upper housing pivoted at one side of the mill to the lower housing and connected at the other side of the mill to a hydraulic ram which effects movement of the top roller in such a manner that the axis thereof describes an arc centered on the pivot axis of the upper and lower housings. By carefully locating the pivot axis it has been found that a substantially constant feed opening to discharge opening ratio can be achieved for the normal working range of the top roller. However, in practice, it is often desirable to modify the aforesaid ratio and this latter mill does not permit this to be done during operation of the mill.

OBJECTS OF THE INVENTION

In view of the above it is the aim of the invention to achieve the following objects singly or in combination:

- to provide a mill which automatically responds to different feed conditions including throughput and cane quality by automatically adjusting the feed and discharge openings;
- to provide a mill which automatically maintains constant pressure on material passing through the rollers;
- to provide a mill with pivotable and adjustable frame elements for mechanically responding to differing conditions; and
- to provide a mill applicable for cane sugar, but suitable for other uses as well.

SUMMARY OF THE INVENTION

The present invention provides a mill comprising a feed roller, a top roller, a discharge roller, a housing including two upstanding spaced frames between which said rollers extend, the axes of the rollers being parallel to each other, bearings at opposite ends of the top roller being carried respectively by the two upstanding frames, bearings at opposite ends of the feed roller being mounted respectively in first chairs which are mounted for pivotable movement by first power operated means to vary the feed opening between the feed roller and the top roller, and bearings at opposite ends of the discharge roller being mounted respectively in second chairs which are mounted for pivotable movement by second power operated means to vary the discharge opening between the discharge roller and the top roller, there being further provided a trash plate for transferring material between the feed opening and the discharge opening, the trash plate being disposed between the feed and discharge rollers and being connected to said first chairs for movement therewith.

Preferably, the first and second chairs are pivotably mounted on the housing.

In a preferred embodiment, the pivot axes of the first and second chairs are disposed adjacent to the center plane of the mill (as hereinafter defined). In this case, the pivot axis of the first chairs may be disposed on the discharge side of the center plane and in a plane parallel to the center plane and passing through or substantially passing through the heel of the trash plate, i.e., that part of the trash plate nearest to the discharge roller periphery. The pivot axis of the first chairs may also lie in a plane through the feed roller axis and normal to the plane intersecting the top and feed roller axis. The pivot axis of the second chairs may be disposed upwardly and to the discharge side of the axis of the first chairs and may lie in a plane through the discharge roller axis and normal or substantially normal to the plane intersecting the top and discharge roller axis.

It is to be understood that by the expression "center plane of the mill" is meant the plane which bisects the included angle between a first plane intersecting the feed and top roller axes and a second plane intersecting the discharge and top roller axes.

Preferably, the arrangement of the mill is such that in operation as the feed and discharge openings increase in a constant or substantially constant ratio, the area of opening between the heel of the trash plate and the discharge roller increases, in an increasingly disproportional manner. Other preferred embodiment features are summarized as follows:

the first and second chairs are supported at their pivots on spherical plain radial bearings.

The trash plate is adjustably connected to the first chairs so that the trash plate can be maintained in constant mesh with the feed roller during movement of the first chairs and during wear of the feed roller. The first and second power operated means each comprise hydraulically actuated means, including two actuating devices for respectively pivoting the chairs at opposite ends of the associated roller independently of each other.

Each chair has a lug projecting from that side thereof remote from its respective pivot axis, each lug extending through an opening in an adjacent part of an adjacent frame. The outer end of each lug is connected to a respective actuating device. Alternatively, each actuating device may be mounted so as to act on a respective chair along a line or substantially along a line intersecting the axis of the top roller and the axis of the respective feed or discharge roller.

The housing comprises two beds or bed portions, said two frames which are rigidly connected to respective bed or bed portions and each of which has arms upwardly extending from the bed or bed portions defining between said arms a space in which respective first and second chairs are located, and a stool which is supported by each bed or bed portion between the arms of each frame and on each of which a respective first and second chair is pivotably mounted, the height of the stools being variable relative to the respective bed or bed portions.

Each frame is substantially A-shaped. At least one arm of each frame is pivotally connected to the respective bed or bed portion and the other arm is releasably connected to the respective bed so that when the connection between said other arm and the bed is released, the frame can pivot so as to permit access to the chairs. Alternatively, both arms of each frame are releasably connected to the respective bed or bed portion so that either or both frames can be removed therefrom.

The axes of the three rollers define a triangle the apex angle of which is substantially 74°. The feed roller may be arranged at a lower level than the discharge roller. This may be achieved by inclining the mill at substantially 15° to the feed side. Each first chair is so mounted as to be capable of a limited universal movement.

BRIEF FIGURE DESCRIPTION

In order that the invention may be clearly understood, it will now be described, by way of example, with reference to the accompanying drawings, wherein.

Figure 1:
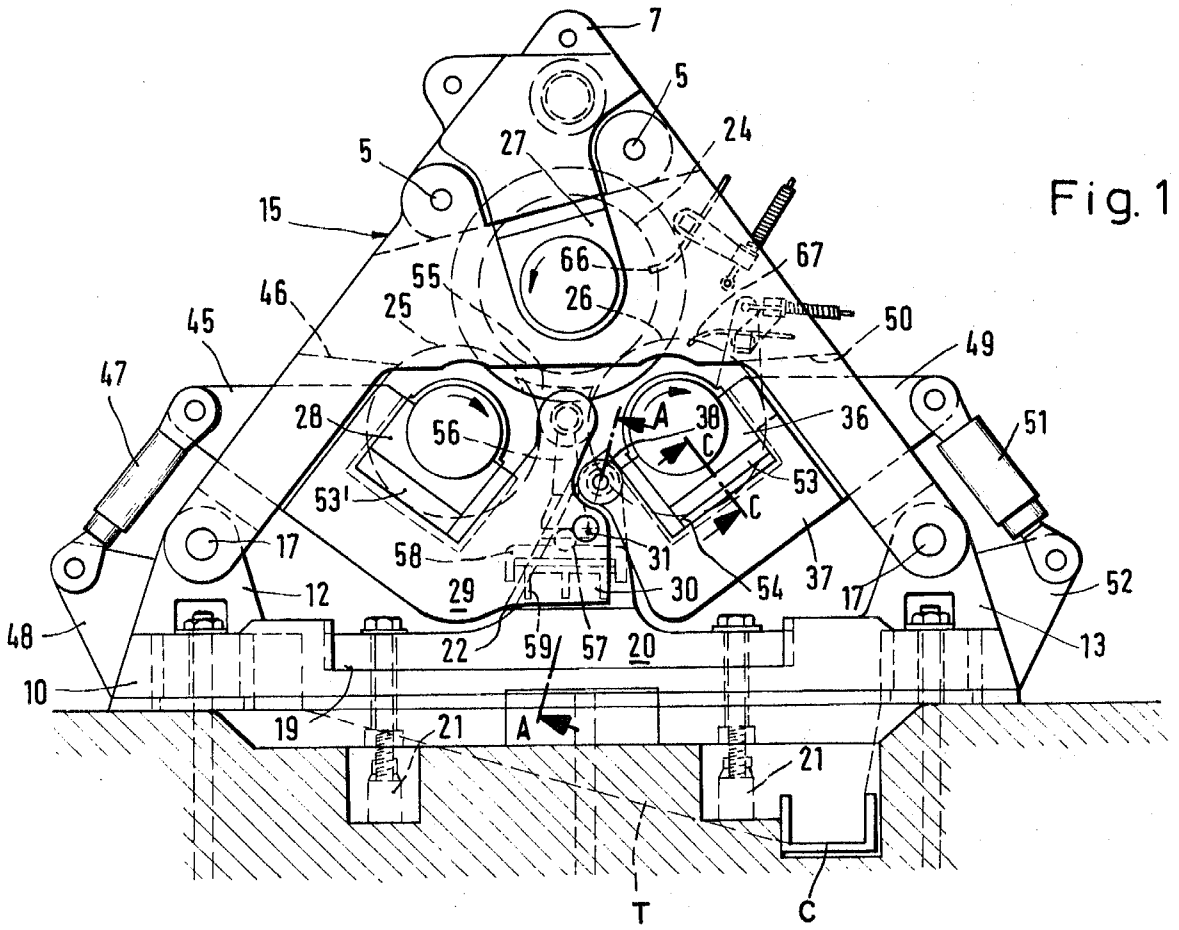
FIG. 1 is an end view of one embodiment of a mill according to the invention.

DETAILED DESCRIPTION OF PREFERRED EXAMPLE EMBODIMENTS AND OF THE BEST MODE OF THE INVENTION

FIGS. 1 to 4 show a mill for extracting juice from cane sugar, comprising a housing which includes a pair of spaced apart cast steel beds 10, 11 securely fixed to the ground and located at opposite ends of the mill. Each bed has integrally formed therewith a pair of upstanding lugs 12, 13, which are spaced apart so as to be located on opposite sides of the mill. Each lug 12, 13 has an aperture 14 which extends therethrough. Two upstanding substantially A-shaped cast steel or fabricated mild steel frames 15 and 16 are rigidly connected to the beds 10 and 11 respectively by removable pins 17 which extend through respective apertures 14 and through aligned apertures 18 in respective bifurcated lower ends of the arms of the frames.

The two mill beds 10 and 11 are linked together on each side of the mill by cast steel or fabricated mild steel beams 9 forming a rigid base for carrying the two A-shaped frames 15 and 16. For added rigidity, a beam 8 is secured between A-frame top caps 6 and 7 each of which is secured to the upper end of respective frames 15, 16 by pins 5 on opposite sides of the mill, each pin extending through an aperture in the top cap and through two aligned apertures in a bifurcated portion at the upper end of an adjacent arm of the A-frame.

A recess 19 is formed in each bed 10, 11 between the lugs 12 and 13 and a cast steel stool 20 is restrained in each recess 19 against horizontal movement but is adjustable in height by inserting packing plates between the stool 20 and its respective bed 10, 11, the stools being liftable by portable hydraulic jacks 21 through mild steel pin extensions (not shown) rigidly forming part of each stool 20 to permit insertion and removal of the packing plates. Each stool 20 has an integral upstanding lug 22 with apertures 23 and 72 therein.

The mill also includes three rollers, i.e., a top roller 24, a feed roller 25 and a discharge roller 26 which are provided with any conventional form of grooving. The rollers extend between the frames 15 and 16 with their axes parallel to each other and forming or substantially forming when viewed in end elevation an isosceles triangle having a horizontal or substantially horizontal base.

The top roller 24 is carried at opposite ends in water cooled gun metal bearings 27, or suitable antifriction bearings, which are removably but rigidly located in the top of the frames 15 and 16, by top caps 7 and 6. The top roller bearings are inclined toward the feed side of the mill by an angle of approximately 15° to the vertical. The top roller does not "float" as in the case of a conventional mill and therefore may be in full alignment with the mill drive gearing.

The feed roller 25 is also carried at opposite ends in water cooled gun metal bearings 28 or suitable antifriction bearings which are carried respectively in two cast steel chairs 29 which are located on the feed side of the mill beneath the webs of the A-shaped frames 15 and 16 respectively and which are pivotally connected to respective lug 22. The pivot axis between the chairs 29 and the lugs 22 lies on a plane which passes through or substantially through the heel of a trash plate 55 and which is parallel and adjacent to the center plane of the mill (as hereinbefore defined), and on a plane through the axis of roller 25 and normal to a plane intersecting the top and feed roller axes. The pivotal connection between each chair 29 and its respective lug 22 is achieved by providing each chair 29 at its inner side with a fiburcated portion 30 (see FIG. 4) between the two spaced parts of which is rigidly secured a pin 31 which supports the inner member 32 of one spherical plain radial bearing, the outer member 34 of which is secured to the inner wall of the aperture 23 in lug 22.

The discharge roller 26 is also carried at opposite ends in water cooled gun metal bearings 36 or suitable antifriction bearings which are carried respectively in two further cast steel chairs 37 which are located on the discharge side of the mill also beneath the webs of the A-shaped frames 15 and 16 respectively and which are pivotably connected to the respective lug 22. The pivot axis between lugs 22 and chairs 37 is positioned as close as possible to the aforesaid center plane on the discharge side of the mill and lies on a plane through the discharge roller axis and normal to the plane intersecting the top and discharge roller axes, above the feed roller chair pivot axis. The pivotable connection between each chair 37 and each lug 22 is achieved by providing each chair 37 at its inner side with bifurcated portion 35 (see FIG. 4) between the two spaced parts of which a pin 38 extends. The pin 38 is rigidly secured in an aperture 72 in lug 22 and at its ends supports inner members 39 and 40 of spherical plain radial bearings, the outer members of which are secured in apertures 43 provided in the spaced parts of the bifurcated portion 35.

Each feed roller chair 29 has an integral lug 45 projecting outwardly from its outer side, each lug 45 extending through an opening 46 in the adjacent arm of the frame 15, 16 and is connected at its outer end to one end of a hydraulic ram 47 by a plain spherical bearing. The other end of the ram 47 is connected to a lug 48, integral with the bed 10, 11 and projecting laterally therefrom, by a further plain spherical bearing.

Hydraulic pressure exerted by the rams 47 on the feed roller 25 will be transmitted to the passage of cane through the mill and against the top roller.

Each discharge roller chair 37 also has an integral lug 49 projecting outwardly from its outer side, each lug 49 extending through an opening 50 in the adjacent arm of the frame 15, 16 and being pivotably connected at its outer end to one end of a hydraulic ram 51, the other end of which is pivotably connected to a lug 52 integral with the bed 10, 11 and projecting laterally therefrom. Hydraulic pressure exerted by the rams 51 on the discharge roller 26 will be transmitted to the passage of cane through the mill and against the top roller.

The rams 47 and 51 each have associated therewith a nitrogen pre-charged accumulator (not shown).

Thus, any desired ratio of feed opening to discharge opening may be maintained without varying the applied hydraulic pressures to rams 47 and 51 as the openings themselves vary due to changes in cane quality, throughout or wear on the rollers.

It has been found advantageous to provide for an apex angle of the triangle defined by the axes of the three rollers of 74° or substantially 74°. This angle should be maintained for all mill settings and the wide range of roller diameters used in a mill tandem. To achieve this feature, the feed and discharge roller bearings 28 and 36 are adjustable laterally on their seats by inserting mild steel packing plates between the bearings 28 and 36 and the cast steel chairs 29 and 37 respectively on one or both sides of the bearings.

Moreover, to accommodate uneven lift along the length of the discharge roller during operation, a cast steel pressure plate 53 with a large radius machined seat and mating plate 54 are inserted between the base of each bearing 36 and the chair 37. The radius of the machined seat is centered on the discharge roller axis. The pressure plate 53 is located between flanges of the bearing 36 while the mating plate 54 is located in a recess in the chair 37. Uneven lift along the length of the feed roller 25 during operation is accommodated by the movement of each chair 29 on the spherical plain radial bearings 32, 34. A cast steel pressure plate 53', with machined seat parallel with the feed roller axis and integral with chair 29, supports bearings 28. The bearing 28 has flanges which locate on the pressure plate to prevent axial movement of the feed roller 25.

A trash plate 55 is disposed between the feed and discharge rollers for transferring bagasse therebetween. The upper surface of the trash plate 55 is convex and it extends along the length of the rollers. The trash plate 55 is rigidly, but removably secured to a beam 56 by bolts (not shown). The lower end of the beam 56 (not shown) has a machined recess for receiving at each end the outer member of a plain spherical radial bearing (not shown), the inner member of which is mounted on a steel pin which is rigidly secured in two upstanding lugs integral with a trunnion 57. A steel cap with machined recess for the outer member of each of said last mentioned plain spherical radial bearings secures the bearings to the lower end of the beam 56. The trunnion 57 is integrally cast with a chair 58 which is carried by a stool 59 integrally cast with the adjacent feed roller chair 29. The chair 58 is secured to the stool 59 by through bolts (not shown) to allow for initial adjustment of the trash plate 55 together with the beam 56, the chair 58 being capable of lateral adjustment by means of jacking screws (not shown) and of vertical adjustment by means of packing plates inserted between the chair 58 and stool 59. Each trunnion 57 is supported for angular movement at each end in a chair 58 which is carried by a stool 59 secured to the adjacent feed roller chair 29. The beam has a recess 60 at each end at a position adjacent to its upper edge and this recess rotatably houses an eccentric cam 61 which is integral with a spindle 62 which projects longitudinally through an aperture 63 in an adjacent portion of the feed roller chair; to accommodate any misalignment between the trash plate 55 and feed roller 25 resulting from uneven lift of the feed roller chairs during operation, the eccentric cam 61 of each spindle 62 carries a spherical plain bearing 68 on which a sliding block (not shown) is fitted, the latter sliding in the beam recess 60. The trash plate 55 is thus connected between the feed roller chairs for movement therewith so as to maintain constant mesh with the feed roller as the feed opening is varied. Constant mesh between the trash plate 55 and feed roller can be maintained as the trash plate and feed roller wear by turning the spindle 62 which by virtue of engagement between the cam 61, the spherical plain bearing 68 with sliding block and the wall of the recess 60 pivots the beam 56 about the axis of trunnions 57. At its ends the top roller has flanges 64 and 65 which overlap upper sections or rollers 25 and 26 and ends of trash plate 55 to prevent bagasse being extruded sideways and to locate the feed roller against axial movement. Instead of flanges 64 and 65, fixed, non-rotational plates may be provided to contain the bagasse and locate the feed roller.

Scrapers 66 and 67 are spring loaded into contact with the top and discharge rollers respectively and require no adjustment to compensate for wear on the tips. The scraper 66 is carried off frames 15 and 16; the scraper 67 is carried off the discharge roller pressure plate 53.

Adjustable mechanical stops (not shown) to limit the movement of the feed and discharge rollers to 1" and ½" respectively are provided, as are lift indicators (not shown) associated with the feed and discharge rollers.

Vertical adjustment of the stools 20 as previously mentioned is desirable to accommodate the wide range of mill settings used in the mill tandem of say six mills in addition to the wide range of roller centers resulting from using worn rollers.

To maintain the aforesaid apex angle at 74° and accommodate the full range of mill settings for a mill tandem of, for example, six 42"×84" mills and allow for a maximum roller wear of 3" on diameters on any mill in the tandem, provision could be made so as to permit height adjustment of the stools 20 of up to 6 inches and lateral adjustment of the feed and discharge roller bearings 28 and 36 of up to 3.5 inches, which adjustments are not limited.

The mills in a tandem are initially assembled, prior to the start of crop, to conventional settings; thereafter and during operation, settings are automatically adjusted according to throughput and cane quality by the constant hydraulic pressures applied to respective side rollers. The mill is, therefore, fully self-setting and hydraulic pressures applied to respective feed and discharge rollers, maintain substantially a constant ratio between the feed and delivery openings for all conditions of feed.

In addition to the aforementioned advantages it is believed that in the above mill, the juice opening between the trash plate 55 and discharge roller 36 will increase with more cane throughput as compared with a conventional mill having the opposite effect. Indeed, as the feed and discharge openings increase in a constant or substantially constant ratio, it is believed that the area of opening between the heel of the trash plate and the discharge roller will increase in an increasingly disproportionate manner. This feature should result in better juice drainage and improved extraction.

Furthermore, access to all three rollers can be readily obtained. Access to the top roller bearing 27 is achieved by removing the pins 5 on, for example, the feed side of the mill and thereafter pivoting the top caps 6 and 7 together with beam 8 toward the discharge side of the mill about the remaining pins 5. Access to the feed and discharge roller bearings 28 and 36 is achieved by removing pins 17 on, for example, the feed side of the mill and pivoting the A-shaped frames 15 and 16 toward the discharge side of the mill about the remaining pins 17. The A-shaped frames 15 and 16 can also be removed as a unit by removing pins 17 on the feed and discharge sides of the mill and lifting the frames together with the top roller caps 6 and 7, the beam 8 and top roller 27, provided the capacity of the crane is capable of lifting the weight. To reduce the aforementioned weight, the top roller 27 could be removed prior to lifting the A-shaped frames 15 and 16 complete as one unit with top roller caps 6 and 7 and beam 8.

Figure 5:
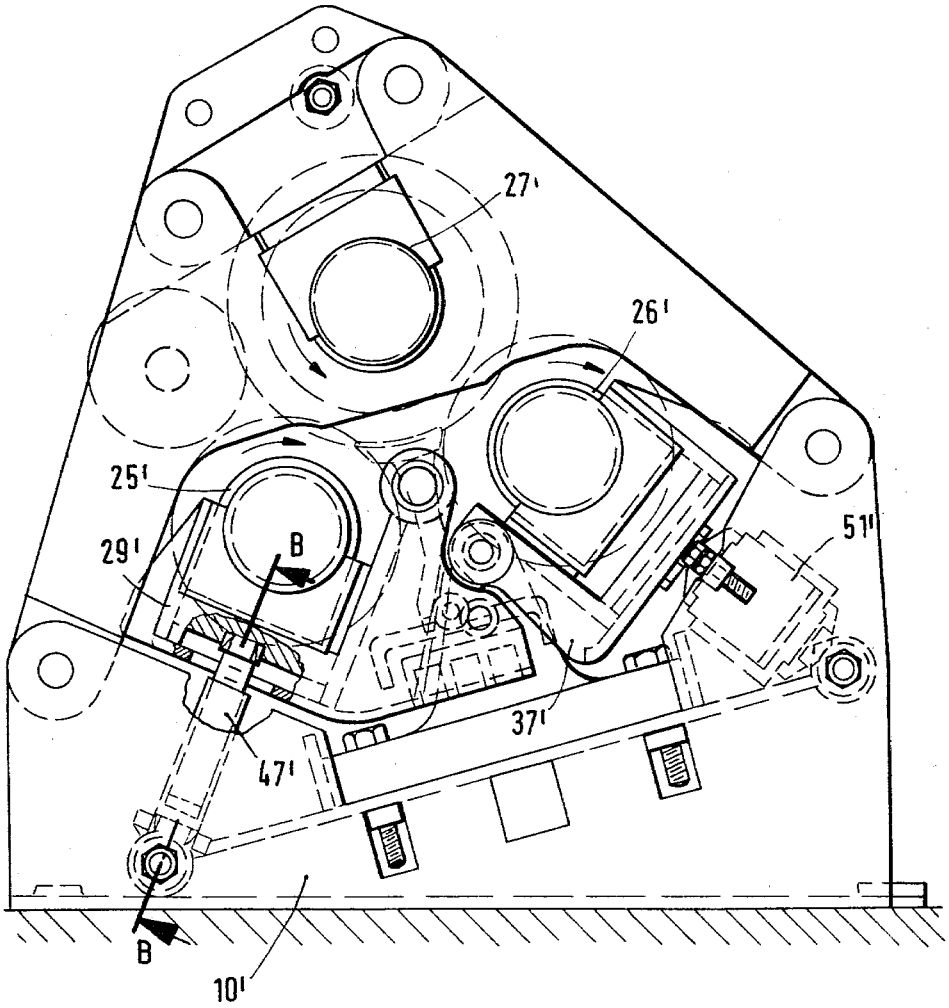
FIG. 5 is an end view of another embodiment of a mill according to the invention.
Figure 6:
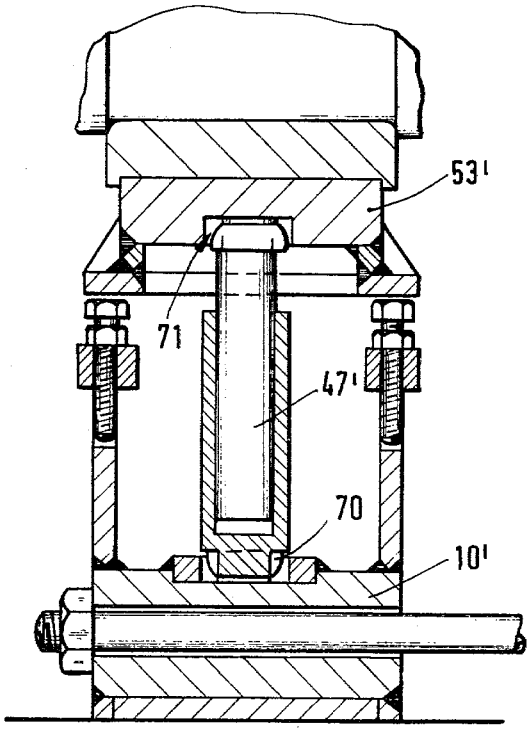
FIG. 6 is a sectional view along line B—B of FIG. 5.

Referring to FIGS. 5 and 6, the mill shown therein is a slightly modified version of the mill previously described with reference to FIGS. 1 to 4.

The mill of FIGS. 5 and 6 differs essentially from the previously described mill in that:

(1) the mill is inclined at substantially 15° to the feed side. Thus, the feed roller 25' is arranged at a lower level than the discharge roller 26'. This results in improved juice drainage off the feed and discharge rollers;

(2) the hydraulic rams 47' and 51' which act on the feed and discharge rollers 25' and 26' respectively are mounted in respective cast steel or fabricated mild steel beds 10' with their axes coincidental or substantially coincidental with a line intersecting the axis of the top roller 27' and the axis of the respective feed or discharge roller 25' or 26'. Each ram 47' is connected to the respective bed 10' by a plain angular contact bearing 70 and is connected to the pressure plate 53' by a further plain angular contact bearing 71. Each ram 51' is pivotably connected to respective bed 10' and to the respective chair 37'. Provision of the rams 47' and 51' as aforesaid and within the confines of the A-shaped frames 15' and 16' leads to a more compact mill than the mill shown in FIGS. 1 to 4 and minimizes any sag of the feed and discharge roller chairs 29' and 37' respectively.

Figure 2:
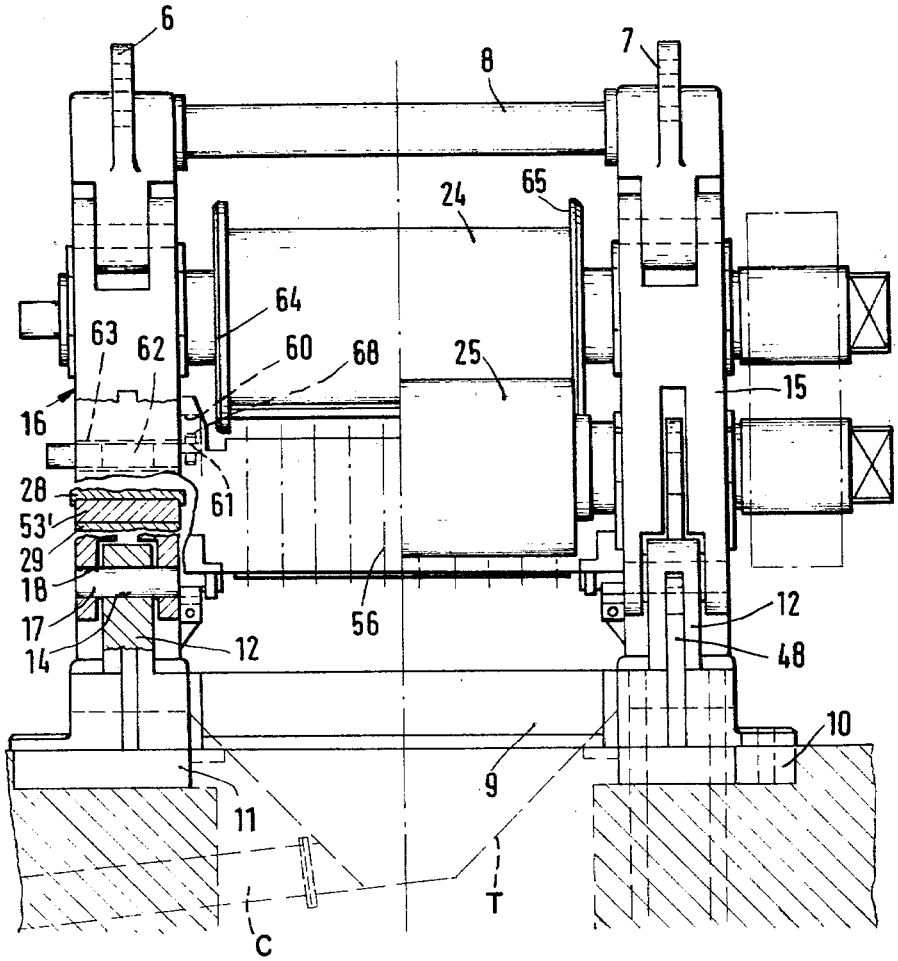
FIG. 2 is a side view of the mill shown in FIG. 1 and partly sectioned for reasons of clarity.
Figure 3:
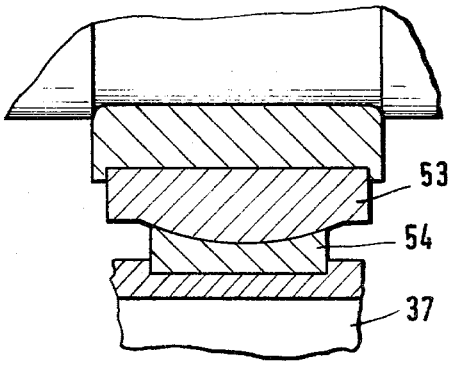
FIG. 3 is a sectional view along line C—C of FIG. 1.
Figure 4:
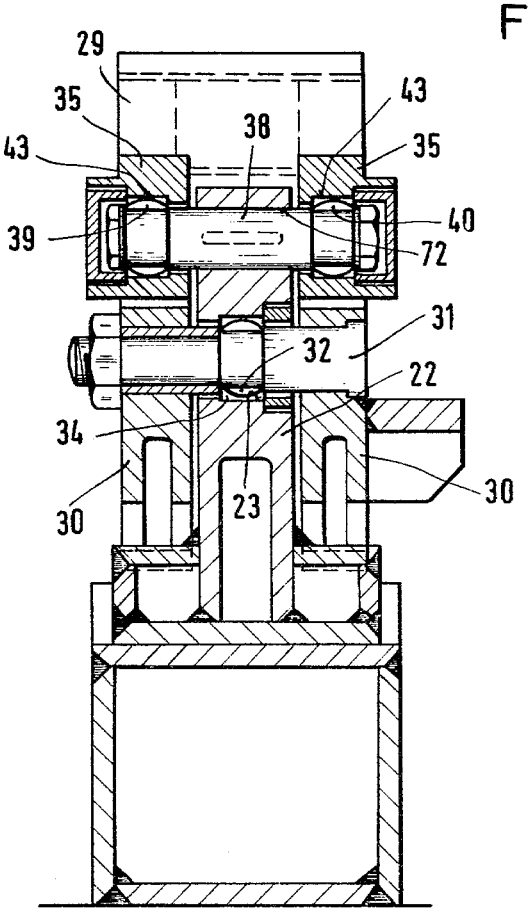
FIG. 4 is a sectional view along line A—A of FIG. 1.

Incidentally, the pressed out juice is collected in a funnel type tray T leading into a discharge conduit C shown in dashed lines in FIG. 2. The tray T is shown by dashed lines in FIG. 1. The conduit C is shown by full lines in FIG. 1. The tray T and conduit C are conventional.

Although the invention has been described with reference to specific example embodiments, it is to be understood that it is intended to cover all modifications and equivalents within the scope of the appended claims.

What is claimed is:

1. A mill comprising a feed roller (25), a top roller (24), and a discharge roller (26), housing means defining a center plane and including two upstanding spaced frames (15, 16) between which said rollers extend, the axes of the rollers being parallel to each other, first bearing means at opposite ends of the top roller (24) and carried respectively by the two upstanding frames, second bearing means at opposite ends of the feed roller (25), first chair means (29) operatively mounted in said housing means and supporting said second bearing means for pivotable movement of said feed roller about a first pivot axis defined by said first chair means, operatively mounted first power operated means coupled to said first chair means for varying the feed opening between the feed roller and the top roller, third bearing means at opposite ends of the discharge roller, second chair means (37) operatively mounted in said housing means and supporting said third bearing means for pivotable movement of said discharge roller about a second pivot axis defined by said second chair means, operatively mounted second power operated means coupled to said second chair means for varying the discharge opening between the discharge roller and the top roller, trash plate means (55) for transferring material between the feed opening and the discharge opening, said trash plate means (55) being disposed between the feed and discharge rollers and being coupled to said first chair means for movement therewith, said first and second pivot axes defined respectively by said first and second chair means being disposed adjacent to said center plane of the mill, said first pivot axis for said feed roller means being disposed on the discharge side of said center plane and in a plane parallel to the center plane and passing through or substantially passing through a heel of said trash plate means (55), the mill being structured such that mill settings are automatically adjusted according to throughput and quality of throughput by constant pressures applied respectively to said feed roller and to said discharge roller by said first and second power operated means and such that the ratio between the feed and discharge openings is maintained substantially constant for all conditions of feed.

2. The mill of claim 1, wherein the first and second chair means are pivotably mounted on the housing.

3. The mill of claim 1, wherein the pivot axis of the first chair means also lies in a plane through the feed roller axis and normal or substantially normal to the plane intersecting the top and feed roller axes.

4. The mill of claim 1, wherein the pivot axis of the second chair means is disposed upwardly and to the discharge side of the axis of the first chair means.

5. The mill of claim 4, wherein the pivot axis of the second chair means also lies in a plane through the discharge roller axis and normal or substantially normal to a plane intersecting the top and discharge roller axes.

6. The mill of claim 1, wherein the rollers and said trash plate means are constructed and arranged so that in operation as the feed and discharge openings increase in a constant or substantially constant ratio, the area of opening between the heel of the trash plate means and the discharge roller increases, in an increasingly disproportional manner.

7. The mill of claim 1, wherein the first and second chair means are supported at their pivots on spherical plain bearings.

8. The mill of claim 1, wherein the trash plate means is adjustably connected to the first chair means so that the trash plate means can be maintained in constant mesh with the feed roller during movement of the feed roller and during wear of the feed roller.

9. The mill of claim 1, wherein said first and second power operated means each comprise hydraulically actuated means.

10. The mill of claim 1, wherein the first and second power operated means each comprise two actuating devices for pivoting the respective first and second chair means at opposite ends of the associated roller independently of each other.

11. The mill of claim 10, wherein each chair means has a lug projecting from that side thereof remote from its respective pivot axis, each lug extending through an opening in an adjacent part of an adjacent frame and its outer end being connected to a respective actuating device.

12. The mill of claim 10, wherein each actuating device is mounted so as to act on a respective chair means along a line or substantially along a line intersecting the axis of the top roller and the axis of the respective feed or discharge roller.

13. The mill of claim 1, wherein said housing means comprises two beds or bed portions, said two frames being rigidly connected to respective bed or bed portions and each of said frames has arms upwardly extending from the bed or bed portions defining between said arms a space in which respective first and second chair means are located, and stool means which are supported by each bed or bed portion between the arms of each frame and on each of which the respective first and second chair means is pivotably mounted, the height of the stool means being variable relative to the respective bed or bed portions.

14. The mill of claim 13, wherein each frame is substantially A-shaped.

15. The mill of claim 13 or 14, wherein at least one arm of each frame is pivotably connected to the respective bed or bed portion and the other arm is releasably connected to the respective bed or bed portion so that when the connection between said other arm and the bed is released, the frame can pivot so as to permit access to chair means.

16. The mill of claim 13 or 14, wherein both arms of each frame are releasably connected to the respective bed or bed portion so that either or both frames can be removed therefrom.

17. The mill of claim 1, wherein the axes of the three rollers define a triangle, the apex angle of which is substantially 74°.

18. The mill of claim 1, wherein the feed roller is arranged at a lower level than the discharge roller.

19. The mill of claim 18, wherein the mill is inclined at substantially 15° to the feed side.

20. The mill of claim 1, wherein each first chair means is so mounted as to be capable of limited universal movement.

* * * * *